United States Patent [19]

Young

[11] Patent Number: 4,800,594

[45] Date of Patent: Jan. 31, 1989

[54] PANTS EPAULET AND BINDER

[75] Inventor: W. Bradley Young, Marietta, Ga.

[73] Assignee: Youngstuff, Inc., Atlanta, Ga.

[21] Appl. No.: 127,986

[22] Filed: Dec. 3, 1987

[51] Int. Cl.[4] ..... A41F 9/00

[52] U.S. Cl. ..... 2/237; 2/DIG. 6; 2/221; 24/442

[58] Field of Search ..... 24/442, 443, 444, 445, 24/446, 447, 448, 449, 450, 117, 140; 2/DIG. 6, 237, 221

[56] References Cited

U.S. PATENT DOCUMENTS

| | | | |
|---|---|---|---|
| 2,014,802 | 9/1935 | Gulke | 2/237 |
| 2,080,246 | 5/1937 | Wengen | 2/237 |
| 2,970,597 | 2/1961 | Michel | 24/442 |
| 3,036,529 | 4/1963 | Munz et al. | 2/DIG. 6 |
| 3,038,166 | 6/1962 | Tobias | 2/237 |
| 3,161,890 | 12/1964 | Betz | 2/237 |
| 4,509,214 | 4/1985 | Shea | 2/DIG. 6 |
| 4,674,157 | 6/1987 | Litz | 24/442 |

FOREIGN PATENT DOCUMENTS

| | | | |
|---|---|---|---|
| 2178795 | 2/1987 | United Kingdom | 24/442 |

*Primary Examiner*—Victor N. Sakran
*Attorney, Agent, or Firm*—Thomas & Kennedy

[57] ABSTRACT

A pants epaulet and binder has a flexible band of a length greater than the spacing between adjacent waist loops of the pants. The ends of the band are foldable to pass through the loops and underlay intermediate portions of the band and be releasibly held thereto by fasteners.

5 Claims, 1 Drawing Sheet

PANTS EPAULET AND BINDER

TECHNICAL FIELD

This invention relates to articles for use in supporting and adorning garments about the waist.

BACKGROUND OF THE INVENTION

Pants and skirts are commonly designed to be supported about the waist of a wearer by means of belts passed through a set of loops secured about the waist of the garments and fastened to themselves. Belts are commonly constructed of attractive materials to complement the garments aesthetically. Personal expressions of fashion through selection of belts are thus normally limited to their design and color. Threading and unthreading of belts through the loops can often be tedious due to tight fits that are created where the width of the belt closely matches that of the loops.

SUMMARY OF THE INVENTION

A new type of clothing article has now been developed which can be used both as a new form of binder for securing pants snuggly to the waist as well as to serve as an ornamental strip or epaulet.

In one form of the invention a pants epaulet is provided for adorning the waist of pants of the type having a pair of adjacent belt loops secured to the pants waist at a selected spacing. The pants epaulet comprises a flexible band of a length greater than the loops spacing adapted to overlay the pair of loops with band far end portions located beyond the loops and band near end portions located adjacent to and between the loops. The pants epaulet also has means mounted to one side of the band for releasibly fastening adjacent far end portions to near end portions with the band overlaying the loops and with the far end portions folded behind the near end portions and extending through the loops.

In another form of the invention a pants binder is provided for releasibly supporting about the waist of a wearer pants of a type having at least one pair of loops secured to the pants waist at a selected spacing. The pants binder comprises a flexible band of a length greater than the loops spacing adapted to overlay the pair of loops and opposite ends of the band folded and tucked through the loops so as to pull the loops towards one another. The pants binder also has fastening means mounted to the band for releasibly fastening the opposite ends of the bands to portions of the bands located intermediate the end portions with the loops pulled towards each other in releasibly binding the pants to the wearer.

In yet another form of the invention a method is provided for releasibly binding pants of the type having at least one pair of loops secured to the pants waist at a selected spacing. The method comprises the steps of tucking end portions of a flexible band through the loops and under intermediate portions of the band located between the loops. Each end portion of the band is then releasibly fastened to an intermediate portion of the band with the band drawing the loops towards one another.

DETAILED DESCRIPTION

Figure 1:
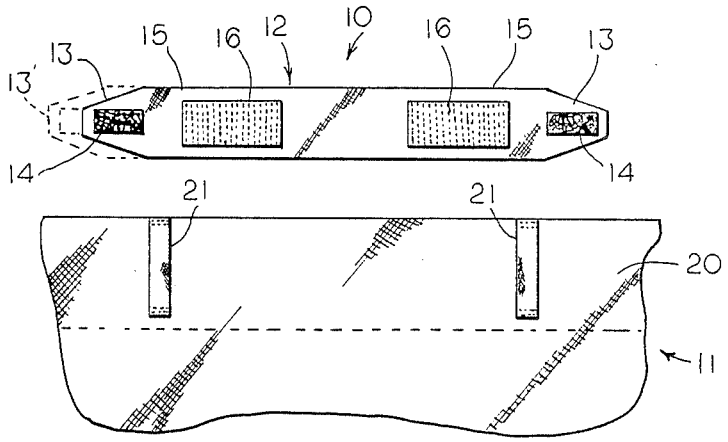
FIG. 1 is a rear view of a pants binder and epaulet shown positioned above the waist band portion of pants to attachment.
Figure 2:
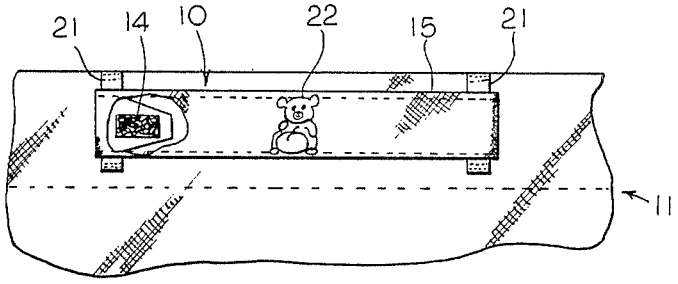
FIG. 2 is a view similar to that of FIG. 1 but showing the binder and epaulet attached to the pants.

With reference next to the drawing, there is shown in FIGS. 1 and 2 a binder or epaulet 10 comprised of a flexible band such as a strip of fabric. Where the band is of the length illustrated by solid lines in FIG. 1 it serves as a binder in binding pants to the waist of a wearer. Where the band is slightly longer, as shown by extended broken lines in FIG. 1, it functions as an epaulet rather than as a binder. In that case it serves as an article to enhance the fashionability of the pants rather than to bind the pants as belts conventionally do. This distinction in the length of the article is made relative to the spacing between two waist loops 21 mounted to the waistband 20 of a pair of pants 11. The term pants is meant in a general sense here to include any garment that is worn about the waist that has loops secured to the waist for the reception of a belt threaded therethrough. Thus, the term pants is meant to include skirts, dresses and the like.

The flexible band is seen to have two tapered far end portions 13 to each of which a strip or pad of fibers 14 is mounted. The band also has two near end portions 15 to which two other strips or pads of fibrous materials 16 are mounted. The fibrous materials 14 and 16 are configured to be releasibly interlocked to each other when pressed together. Thus, they may be provided by mating Velcro materials that are commonly used today as fibrous fastening means. The opposite side of the band 10 bears an ornament which in FIG. 2 is seen to be a teddy bear 22.

To mount the epaulet or binder the band is positioned over the adjacent loops 21 with its side shown in FIG. 1 that bears the Velcro pads facing the waist band 20 and with the far end portions 13 located beyond the loops 21. The far end portions bearing the fibrous material pads 14 are then folded and tucked back through the loops 21 so as to underlay the fibrous pads 16, as shown at the left in FIG. 2. In this manner the pads 14 and 16 become mated by their interlockable fibers and held to each other with the band mounted to the pants.

As previously stated, where the band 10 functions only as an ornamental epaulet the attachment of the fibrous pads is such that the loops 21 are not pulled or drawn towards one another. On the other hand, where the band is to function as a binder in drawing the pants securely about the hips of the wearer, the band is folded along folds made closer to the loops so that after the far ends have been tucked and releasibly attached to the near end portions of the band, the loops 21 are drawn by the binder towards one another thereby binding the pants to the wearer.

Figure 3:
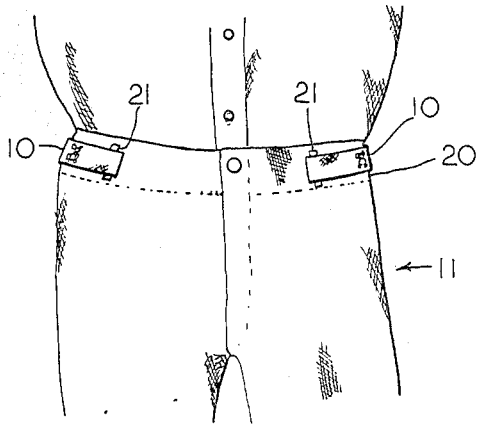
FIG. 3 shows portions of a pair of epaulets or binders mounted to the waistband of a pair of pants.

The binders and epaulets possess much versatility. One, two or even more may be readily attached to the pants waist at various locations for selected binding and aesthetics. In FIG. 3, for example, two epaulets or binders 10 are shown attached to the opposite sides of the pants. Since they are releasibly attached, they may be readily interchanged. This versatility enables the user to change colors or coordination or contrast with the rest of his or her attire. It also enables one to wear ornamented epaulets as befitting an occasion such as a sports event, social gathering or the like. In addition the need for a belt that encircles the waist of the wearer is eliminated since the bands 10 may then themselves provide the function of a belt without having to encircle the pants thereby saving the expense of a complete belt and reducing the time required in threading a belt completely about the waist. If desired, it may also be used to support articles. For example, where made of a strong material such as leather, work tools may be suspended from it. As another example, small loops or pockets may be secured to it to support golf tees It should be understood that the just described embodiment merely illustrates principles of the invention in one preferred form. Many modifications, additions and deletions may be made thereto without departure from the spirit and scope of the invention as forth in the following claims.

I claim:

1. A pants epaulet for adorning the waist of pants of a type having a pair of adjacent belt loops secured to the pants waist at a selected spacing, and with the pants epaulet comprising an integral flexible ornamental band of a length greater than the loops spacing adapted to overlay the pair of loops with band far end portions located beyond the loops and with band near end portions located adjacent and between the loops, and fastening means mounted to an inside of said band for releasibly fastening adjacent far end portion to adjacent near end portions of said band with the band overlaying the loops and with said far end portions folded behind said near end portions and extending through the loops.

2. The pants epaulet of claim 1 wherein said fastening means comprises strips of materials bearing releasibly interlockable fibers secured to one side of said band inside.

3. The pants epaulet of claim 2 wherein a first strip of material is mounted to each of said band near ends and a second strip of material is mounted to each of said band far ends, said first strips of material bearing fibers adapted to be releasibly interlocked with the fibers born by said second strips of material.

4. In a pair of pants that has a pants waist and at least one pair of spaced belt loops secured to said pants waist, the improvement comprising an integral flexible ornamental elongated epaulet mounted to said belt loops with said epaulet having a central portion extending between and overlying said belt loops and tapered end portions folded behind said central portion with each of said end portions extending through one of said belt loops, and fastening means mounted to said epaulet for releasibly fastening said end portions to said central portion.

5. The improvement in pants of claim 4 comprising a pair of said epaulets mounted belt loops on opposite sides of the pants.

* * * * *